United States Patent [19]

Speicher

[11] 4,410,287

[45] Oct. 18, 1983

[54] SINGLE WHEEL BILLET MARKER

[75] Inventor: Edwin W. Speicher, Pittsburgh, Pa.

[73] Assignee: M. E. Cunningham Company, Ingomar, Pa.

[21] Appl. No.: 383,760

[22] Filed: Jun. 1, 1982

[51] Int. Cl.[3] ..... B41F 17/00

[52] U.S. Cl. ..... 400/134; 400/182; 101/4

[58] Field of Search ..... 101/4, 18, 3 R; 400/134, 182

[56] References Cited

U.S. PATENT DOCUMENTS

| | | | |
|---|---|---|---|
| 2,310,430 | 2/1943 | Hart | 400/182 X |
| 3,020,834 | 2/1962 | Brown et al. | 101/4 |
| 3,306,186 | 2/1967 | Voos et al. | 101/18 |
| 3,541,954 | 11/1970 | Speicher et al. | 101/4 X |
| 3,636,871 | 1/1972 | Speicher | 101/4 X |
| 3,659,521 | 5/1972 | Lany | 101/4 |
| 4,212,243 | 7/1980 | Haegermann | 101/4 |
| 4,214,520 | 7/1980 | Eissel | 101/4 |

FOREIGN PATENT DOCUMENTS

| | | |
|---|---|---|
| 2541328 | 3/1977 | Fed. Rep. of Germany . |
| 2653916 | 6/1978 | Fed. Rep. of Germany . |
| 7719566 | 7/1978 | Fed. Rep. of Germany . |
| 2728058 | 1/1979 | Fed. Rep. of Germany . |

*Primary Examiner*—Clifford D. Crowder

*Attorney, Agent, or Firm*—Stanley J. Price, Jr.; John M. Adams

[57] ABSTRACT

Making characters on the periphery of a rotatable marking wheel are selectively rotated into marking position relative to the surface of a billet, ingot, bar, slab or the like by an indexing motor drivingly connected to the marking wheel. The marking wheel is rotatably mounted in a housing that is pivoted toward and away from the billet by an arm structure suspended from a frame. The frame is movable on a support transversely of the pivotal path of the marking wheel housing. The frame is laterally advanced incrementally by an indexing ratchet to move the marking wheel from one marking position to the next marking position to permit the marking wheels to stamp the billet with a series of characters. After the billet is marked with a selected character, the stepping motor rotates the marking wheel until the next desired character is in a position for marking. The frame is then laterally advanced to position the desired character opposite the billet. A lift cylinder pivots the arm structure to move the marking wheel between a raised position remote from the billet and a lowered position opposite the billet. A stamping cylinder coaxially aligned with and connected to the lift cylinder is operable to move the marking wheel housing so that the marking wheel strikes the billet and impresses the character thereon. After the marking step, the stamping cylinder retracts the marking wheel, the indexing ratchet laterally moves the frame, and the indexing motor selectively rotates the marking wheel to the desired character. Once the desired series of characters are impressed on a billet, a return cylinder is actuated to rapidly, laterally move the frame to return the marking wheel to the initial marking position for marking the next billet.

10 Claims, 4 Drawing Figures

SINGLE WHEEL BILLET MARKER

BACKGROUND OF THE INVENTION

1. Field of the Invention

This invention relates to apparatus for marking a workpiece, and more particularly, to a single wheel billet marker movable through an arcuate path into and out of a stamping position and moved from the stamping position to impress a mark on a billet where the marking wheel is also advanced by a frame, movable transversely relative to the arcuate path of the marking wheel through an increment of steps and thereafter rapidly returned to the original marking position for marking the next billet.

2. Description of the Prior Art

In the marking of billets, slabs, bars, ingots, or the like, it is known to impress a series of characters on the face of the workpiece by a single wheel marker that includes a marking wheel having a plurality of marking characters or elements on the peripheral surface thereof. An example single wheel marker is illustrated and described in U.S. Pat. No. 4,214,520. Similar devices are also provided in which a marking head includes a plurality of marking wheels for marking rolled stock and the like, such as disclosed in U.S. Pat. Nos. 3,306,186; 3,541,954; and 3,636,871.

With both single and multiple marking wheel markers, the respective marking wheel is rotated until the desired character on the wheel periphery is in marking position. The wheel is held in position by a suitable locking device, and thereafter, an actuator is remotely actuated to move the marking wheel to strike the billet and impress the selected character thereon. Thereafter, the marking wheel is retracted and the wheel incrementally rotated and moved laterally to the next position for marking the billet. The actuator is sequentially operated to move the marking head so that the character is stamped on the surface of the billet. This operation is repeated through the required sequence of steps to impress a series of marks on the billet.

Once the billet has been marked, the next billet must be moved into position for marking. This requires the marking head to be withdrawn to facilitate the movement of the next billet into position as rapidly as possible so that a number of billets can be marked in rapid succession. To accomplish this the marking wheel, following the marking of a billet, must be moved to a position to facilitate efficient movement of the next billet into position. If the marking wheel cannot be rapidly moved to a convenient location to facilitate the replacement of a marked billet with an unmarked billet, the marking operation is delayed.

It is also the practice, particularly with single wheel markers, to incrementally, laterally move the marking wheel opposite the billet face to stamp the face with a series of marking characters. During the marking operation, this is accomplished automatically in a sequence of steps which include moving the marking wheel to stamp the billet and rotating the marking wheel to place the next desired character in marking position. Once the desired series of characters has been impressed on the billet by incremental lateral movement of the marking wheel it is necessary to return the marking wheel to the initial marking position for marking the next billet. If the marking wheel has been incrementally advanced by the operation of an indexing ratchet, then movement of the wheel is not continuous. To incrementally return the marking head to the initial position is undesirable because it delays the marking of a succession of billets which follow one after another.

Therefore, there is need to provide, in a single wheel marker, apparatus for quickly raising and lowering the marking wheel into the position opposite the billet for marking and, after the incremental lateral advancement of the marking wheel provide rapid return of the marking wheel to the initial position after the desired series of characters have been impressed on a billet.

SUMMARY OF THE INVENTION

In accordance with the present invention, there is provided apparatus for marking a workpiece that includes a marking wheel housing and a wheel rotatably mounted on the housing. The wheel has a plurality of marking elements on the periphery thereof. A support arm has a first end portion pivotally connected to the marking wheel housing and an opposite second end portion. The support arm second end portion is pivotally connected to a frame. Support means guides the frame along a transverse linear path. Control means moves the frame incrementally transversely along the linear path to selectively position the marking wheel housing and the wheel for marking the workpiece with a series of marks. Lift means extends between the frame and the support arm for swinging the marking wheel housing through an arcuate path between a raised position and a lowered position for marking. Stamping means extending from and aligned with the lift means reciprocates the marking wheel housing to impress the desired marking element on the workpiece when the marking wheel housing is in the lowered position.

An indexing ratchet incrementally moves the frame laterally of the workpiece to move the marking wheel housing and the marking wheel to the desired position opposite the workpiece. After the workpiece is stamped, the frame is incrementally moved laterally to the next position. The stamping and incremental lateral movement are continued until the desired series of elements are impressed on the workpiece. A return mechanism connected to the frame rapidly advances the frame along the path of the incremental movement in a continuous motion to return the marking wheel housing to the initial marking position. The lift cylinder swings the marking wheel housing to the raised position so that, as the frame is returned to the initial position, the next workpiece to be stamped is moved into position to permit the stamping of workpieces in rapid succession.

Accordingly, the principal object of the present invention is to provide apparatus for marking a workpiece in which a marking wheel, having peripheral marking elements, is rotatably mounted in a housing and supported for arcuate movement into and out of marking position relative to the workpiece where the marking operation is accomplished by incremental advancement of the marking wheel along a path transverse to the arcuate, stamping movement of the wheel.

Another object of the present invention is to provide a single wheel billet marker efficiently movable into and out of position relative to a billet through an arcuate path so as to permit rapid marking of successive billets.

A further object of the present invention is to provide in a single wheel billet marker, means for incrementally moving a marking wheel in a path transverse to arcuate swinging movement of the marking wheel and, upon completion of marking the billet with a series of characters, rapidly return the marking wheel in a continuous motion to the initial position for marking the next workpiece moved without delay into marking position.

These and other objects of the present invention will be more completely disclosed and described in the following specification, the accompanying drawings and the appended claims.

DESCRIPTION OF THE PREFERRED EMBODIMENT

Figure 1:
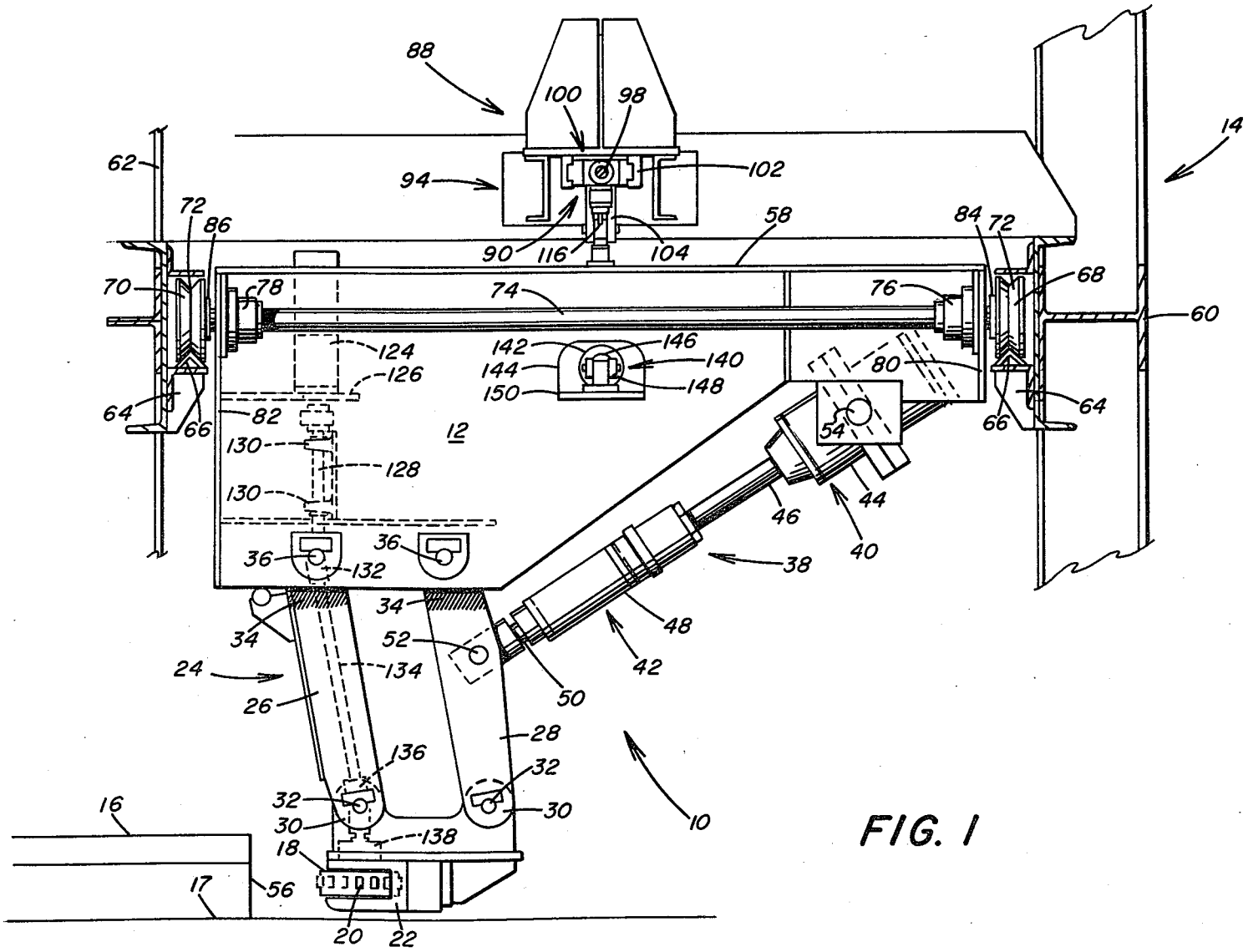
FIG. 1 is a view, in side elevation, of a single wheel billet marker, illustrating a rotatable marking wheel in a position opposite a billet for marking.
Figure 2:
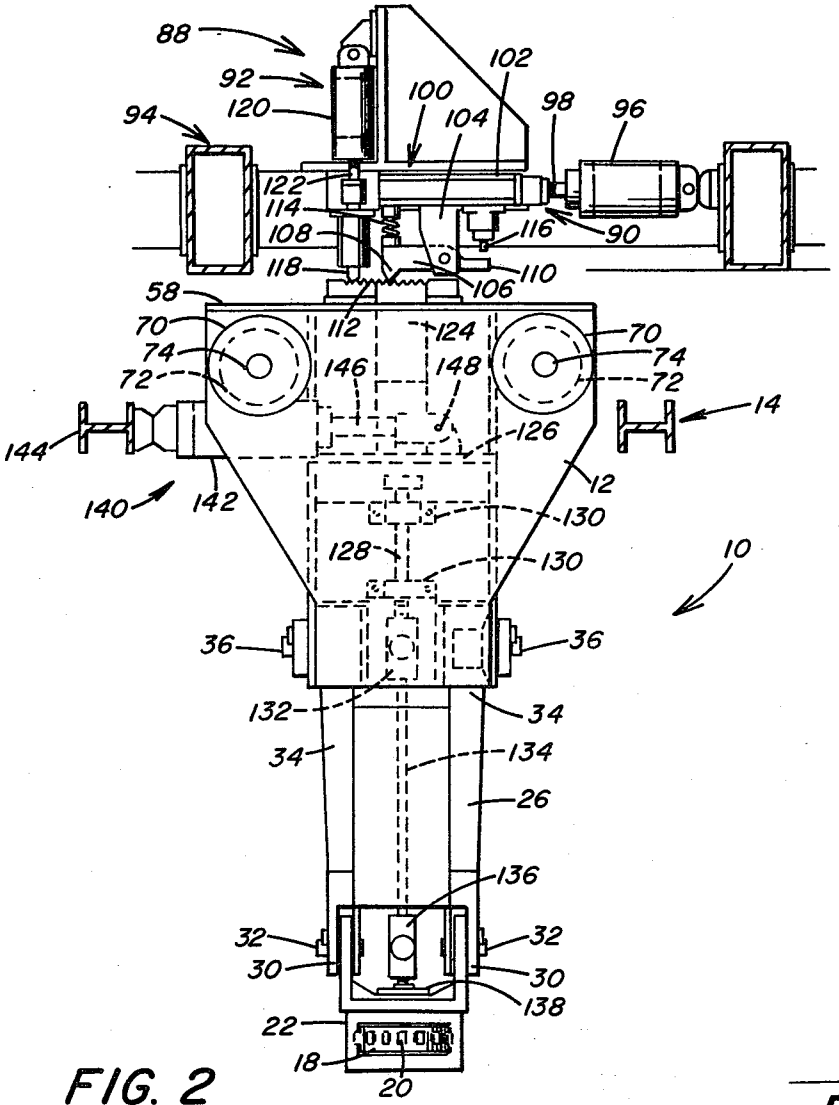
FIG. 2 is a view, in front elevation, of the single wheel billet marker shown in FIG. 1, illustrating a movable frame for selectively moving the marking wheel to stamp a series of marks on the billet.

Referring to the drawings, and particularly to FIGS. 1 and 2, there is illustrated a single wheel billet marker generally designated by the numeral 10 that includes a frame 12 movably positioned on a support structure generally designated by the numeral 14 located adjacent slabs or billets 16 to be marked. The billets to be marked are movably positioned on a roll bed 17. A marking wheel 18 having a plurality of marking characters 20 on the wheel periphery is rotatably supported in a marking wheel housing 22.

The marking wheel housing 22 is pivotally secured to an arm assembly generally designated by the numeral 24 which, in turn, is pivotally connected to the frame 12. The arm assembly 24 includes a pair of arm members 26 and 28 illustrated in FIG. 1. The arm 26 is positioned in front of the arm 28 relative to the billet 16. The arms 26 and 28 are positioned in spaced parallel relation. Each arm member 26 and 28 includes a lower end portion 30 pivotally connected to the marking wheel housing 22 by a pin 32 which is retained in a bearing to permit the arm end portion 30 to pivot on the housing 22. An upper end portion 34 of each arm 26 and 28 is pivotally connected by a pin 36 to the frame 12. The pin 36 is also retained in a bearing to permit the arm end portion 34 to rotate on the frame 12. With this arrangement the arm assembly 24 supports the marking wheel housing 22 for pivotal movement through an arcuate path toward and away from the billet 16.

Figure 3:
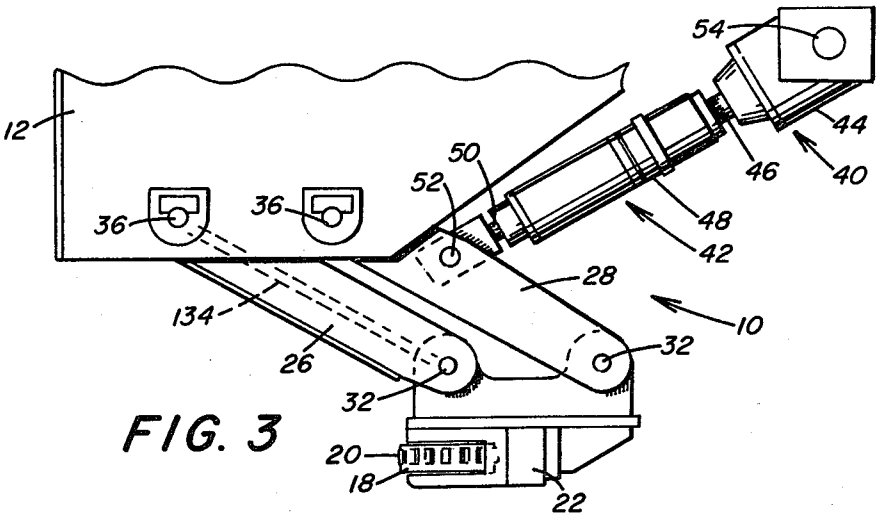
FIG. 3 is a fragmentary view, in side elevation, of the billet marker, illustrating the marking wheel in a raised position removed from the billet.
Figure 4:
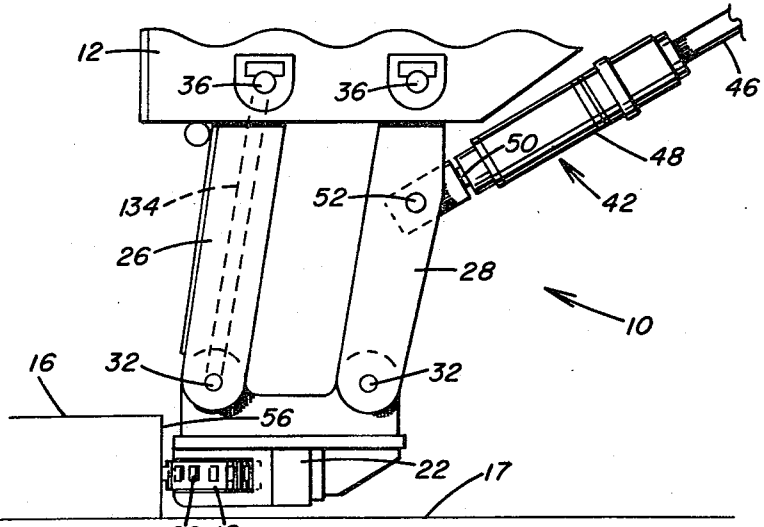
FIG. 4 is a view similar to FIG. 3, illustrating the marking wheel moved into contact with the billet to impress a mark thereon.

An actuating mechanism generally designated by the numeral 38 connected to and extending between the frame 12 and the support arm 24 moves or swings the marking wheel 18 toward and away from the billet 16. In this manner, the marking wheel 18 when in the marking position impresses a series of marking characters on the face of the billet 16. Referring to FIGS. 1, 3, and 4, the actuating mechanism 38 includes a lift cylinder 40 and a stamping cylinder 42. The cylinders 40 and 42 are axially aligned and connected to one another and extend between the frame 12 and the arms 28. The lift cylinder 40 includes a piston cylinder assembly 44 having a piston rod 46 connected at its extreme end to a piston cylinder assembly 48 of the stamping cylinder 42. The piston cylinder assembly 48 also includes a piston 50 which is connected by pins 52 to the arm 28. The lift piston cylinder assembly 40 is pivotally secured by pins 54 to the frame 12.

The lift piston cylinder assembly 40 extends and retracts the piston rod 46 to lower and raise the marking wheel housing 22 and the wheel 18 between the lowered position illustrated in FIG. 1 for marking and the raised position illustrated in FIG. 3 for laterally moving the marking wheel housing 22. In an example operation the lift piston cylinder assembly 40 is provided with a 9 inch stroke to pivotally move the marking wheel 18 in an arcuate path between the raised and lowered positions illustrated in FIGS. 3 and 1 respectively. Once the marking wheel 18 has been moved to the lowered position opposite the billet 16 for marking as illustrated in FIG. 1, the stamping piston cylinder assembly 42 is automatically actuated to stamp or mark the billet 16 by moving the marking wheel 18 from the position illustrated in FIG. 1 to the position illustrated in FIG. 4 where the marking characters 20 are impressed on a vertical face 56 of billet 16. In this example, the stamping piston cylinder assembly 42 is provided with a 5 inch stroke.

Referring to FIGS. 1 and 2, the movable frame 12 is preferably fabricated of plate members and includes a top plate 58 that extends horizontally between the support structure 14. The support structure 14 includes a pair of oppositely spaced support columns 60 and 62. The top plate 58 is movably positioned between the support columns 60 and 62. Flanged brackets 64 are secured to the support column 60 and 62 and extend inwardly therefrom so that they are positioned between the opposite sides of the support columns 60 and 62 and the ends of the top plate 58. A V-shaped channel member 66 is secured to and positioned on an upper horizontal surface of each flanged bracket 64. The V-shaped channels 66 are positioned so that the apexes of the channels extend upwardly and are adapted to receive a first pair of rollers 68 and a second pair of rollers 70. A roller 68 and a roller 70 are illustrated in FIG. 1.

Each roller 68 and 70 is provided with a V-groove 72 complementary with the V-shaped channel 66. Thus the channel 66 provides a track upon which the respective rollers 68 and 70 are rotatably supported on the flanged bracket 64 supported by the support columns 60 and 62. The tracks formed by the channels 66 are positioned in spaced, parallel relation and extend transversely to the arcuate pivotal path of the marking wheel 18.

The rollers 68 and 70 are maintained in spaced relation on the V-shaped channels 66 by connection to the frame 12 through a pair of shafts 74, as illustrated in FIG. 2. As illustrated in FIG. 1, each shaft 74 connects a roller 68 to a roller 70. Thus, one of the shafts 74 connects a first pair of rollers 68 and 70, and the second shaft 74 connects a second pair of rollers 68 and 70. Each shaft 74 has a pair of end portions which extend through bosses 76 and 78 that are secured, in a suitable manner, to end plates 80 and 82 respectively of the frame 12. The shafts 74 extend through the bosses 76 and 78 and are rotatably connected by bearings 84 and 86 to the rollers 68 and 70 to permit rotation of the rollers 68 and 70 on the V-shaped channels 66. With this arrangement, the frame 12 is movable in a path parallel to the channels 66. The path of movement of the frame 12 is transverse to the arcuate path of the movement of the marking wheel 18. Thus, the linear transverse movement of the frame 12 moves the marking wheel 18 laterally across the billet face 56.

In the operation of marking the face 56 of the billet 16, the marking wheel 18 is moved laterally of the billet face 56 in increments or steps. For example, the marking head 18 is laterally movable through a range of 3¾ inches in ten increments of ⅜ inch each. With this arrangement, after each punching or stamping of a marking character 20 on the billet face 56, the marking wheel 18 is moved laterally by movement of the frame 12 through rotation of the rollers 68 and 70 on the channels 66 a distance of ⅜ inch. Following the lateral displacement of the marking wheel 18, the next successive marking character 20 is impressed on the billet face 56.

The incremental lateral movement of the marking wheel 18 is accomplished by a marker and indexing control mechanism generally designated by the numeral 88 in FIGS. 1 and 2. The control mechanism 88 includes an indexing ratchet generally designated by the numeral 90 for incrementally advancing the frame 12 in a path transversely to the pivotal movement of the marking wheel 18. The mechanism 88 also includes a piston cylinder assembly 92 which locks the frame 12 against lateral movement once the frame 12 has been moved by operation of the indexing ratchet 90 into the desired position for marking the billet face 56. The operation of the indexing ratchet 90 and cylinder assembly 92 is sequential and is actuated by a processor (not shown), which is beyond the scope of the present invention. The control mechanism 88 is suspended over the frame 12 by a support generally designated by the numeral 94 in FIG. 2. The support 94 is connected to the support structure 14, as shown in FIG. 1.

The indexing ratchet 90 includes a piston cylinder assembly 96 which is connected at one end to the support 94 and has an extensible piston 98. The end of the piston 98 is connected to a slide assembly generally designated by the numeral 100 which is slidable within a channel block 102. The channel block 102 is connected to the support 94, as illustrated in FIG. 1. The slide assembly 100 includes a downwardly depending arm 104 pivotally connected to an air actuated ratchet 106 shown in FIG. 2. The ratchet 106 includes at one end a pawl 108 and at the opposite end a lever portion 110. The pawl 108 is positioned oppositely of a rack of ratchet teeth 112 which is connected to the top of the frame 12. The pawl 108 is normally urged into engagement with the ratchet teeth 112 by a spring 114 that extends downwardly from the actuating slide 100. An extensible and retractable pin 116, also associated with the actuating slide 100, depends downwardly opposite the lever portion 110.

The actuating slide 100 is sequentially operable to incrementally advance the frame 12 laterally or transversely of the arcuate path of the marking wheel 18 by sequential engagement and disengagement of the pawl 108 with the ratchet teeth 112. The lateral incremental movement of the frame 12 is initiated by actuation of the piston cylinder assembly 96 to extend the piston rod 98, and through suitable means associated with the operation of the piston cylinder 96, to extend the pin 116 downwardly into contact with the lever portion 110. This pivots the ratchet 106 to raise the pawl 108 out of engagement with the ratchet teeth 112. The spring 114 is compressed, and the actuating slide 100 is free to move in the channel block 102 a preselected incremental distance, such as ⅜ inch, to a position opposite the point where the pawl 108 pivots downwardly into engagement with the ratchet teeth 112 by the action of the spring 114 coordinated with upward movement of the pin 116 out of contact with the lever portion 110. With this arrangement, the piston 98 is operable with a ⅜ inch stroke to advance a distance of travel of 3¾ inches in 10 increments. Thus the frame 12 is traversed through a distance of 3¾ inches. Advancement of the piston 98 actuates the downward extension of the pin 116 to pivot the pawl 108 out of contact with the ratchet teeth 112 to permit movement of the actuating slide 100 in the channel block 102.

The cylinder assembly 92 is operable, in coordination with the actuating slide 100, to lock the actuating slide 100 in the desired position for positioning the marking wheel 18 in a preselected marking position. This prevents the marking wheel 18 from moving prior to and during the stamping operation. Preferably, the cylinder assembly 92 includes a locking pawl 118 that is urged toward the ratchet teeth 112 by the operation of a piston cylinder 120 having a piston 122 connected to the locking pawl 118. Extension and retraction of the piston 122 raises and lowers the pawl 118 relative to the ratchet teeth 112. When the actuating slide 100 is moved to the desired position where the pawl 108 engages the ratchet teeth 112, the piston cylinder 120 is actuated to extend the piston 122 and move the locking pawl 118 into engagement with the ratchet teeth 112 to lock the position of the actuating slide 100 relative to the frame 12 and thereby lock the marking wheel 18 in a preselected position. To facilitate engagement of the locking pawl 118 with the ratchet teeth 112, the end of the locking pawl 118 is grooved for insertion into secure engagement with the ratchet teeth 112.

The marking wheel 18 is rotated in the marking head housing 22 to position the desired marking characters 20 in the position for marking the billet face 56 by operation of a servo-type indexing motor 124, illustrated in FIGS. 1 and 2. The indexing motor 124 is securely mounted on a bracket 126 of the frame 12. The indexing motor 124 includes a drive shaft 128 that is rotatably supported in bearings 130 secured to the frame 12. The drive shaft 128 is connected by a coupling 132 to a rotatable shaft 134. The opposite end of the shaft 134 is also drivingly connected by a coupling 136 to a drive head 138. The marking wheel 18 is drivingly connected to the drive head 138 so that rotation generated by the indexing motor 124 is transmitted through the shafts 128 and 134 to the drive head 138 to rotate the marking wheel 18 to bring the selected marking character 20 into position opposite the billet face 56 for stamping the desired marking character on the billet face 56.

The indexing motor 124 is sequentially operated in timed coordination with operation of the stamping cylinder 42 and the indexing ratchet 90. Upon the completion of impressing a preselected marking character on the billet face 56, the marking wheel housing 22 is retracted by withdrawing the piston 50 into the stamping cylinder 42. This moves the marking wheel 18 from the marking position illustrated in FIG. 4 to the position illustrated in FIG. 1.

After the marking wheel 18 is retracted from the marking position, the control mechanism 88 is actuated to initiate operation of the indexing ratchet 90 to advance the frame 12 transversely of the arcuate path of the marking wheel 18 to position the marking wheel 18 in the next position for marking the billet face 56. This operation initiates travel of the rollers 68 and 70 on the channels 66 to laterally move the frame 12 an incremental distance to selectively position the marking wheel 18 in the next marking position. During the lateral movement of the marking wheel 18 to the next marking position the indexing motor 124 is actuated to rotate the marking wheel 18 to position the next desired marking character 20 in the desired position opposite the billet face 56.

Once the desired marking character 20 is in position for stamping the billet face 56, and the frame has been advanced laterally the desired incremental distance, the frame 12 is fixed by engagement of the locking pawl 118 with the ratchet 112. Thereafter, the stamping cylinder 42 is actuated to extend the piston 50 to move the marking wheel 18 to stamp the billet face 56 with the desired marking character 20. It should be understood that any sequence and placement of marking characters can be carried out by the combined movement of the ratchet pawl 108 with the ratchet teeth 112 and rotation of the marking wheel 18 by the indexing motor 124.

To facilitate lateral, transverse movement of the frame 12 relative to the billet face 56, the lift cylinder 40 is operable to raise and lower in a rapid manner the marking wheel housing 22 substantially clear of the billet 16 when a marked billet is exchanged for an unmarked billet. After the billet face 56 has been marked with a series of marking characters, a return cylinder generally designated by the numeral 140 rapidly advances the frame 12 on the support structure 14 back to the initial marking position.

The return cylinder 140 is illustrated in FIGS. 1 and 2 and includes a piston cylinder assembly 142 suitably secured to a beam 144 associated with the support structure 14. The piston cylinder assembly 142 includes a piston 146 connected by a clevis 148 to a support plate 150 of the movable frame 12. The cylinder assembly 142 is operable, upon extension and retraction of the piston 146, to continuously move the frame 12 in a path laterally of the billet 16. Further, as illustrated in FIG. 1, the line of action of the piston cylinder assembly 142 is parallel to the line of action of the indexing ratchet piston cylinder assembly 96, where the piston cylinder assembly 142 is positioned immediately below the piston cylinder assembly 96.

In one operation for example, following the marking of one billet face 56 with a series of characters, the lift cylinder 40 is actuated to move the marking wheel 18 to the raised position clear of the marked billet as illustrated in FIG. 3. This facilitates movement of the next billet 16 to be moved into position without interference by the marking wheel 18 being positioned closely to the billet. Also after the marking wheel 18 has incrementally advanced the full length of travel in a billet marking operation, the return cylinder 140 permits continuous rather than incremental return movement of the marking wheel housing 22 to the initial position. The return piston cylinder assembly 142 is actuated to advance the frame 12 by movement of the rollers 68 and 70 on the channels 66 back to the initial position. This facilitates rapid marking of successive billets without delay attributed to return of the frame 12 and marking wheel 18 to the initial marking position. Thus the frame 12 is rapidly returned in a continuous travel to its initial position, as opposed to returning the frame 12 to the initial position in increments or steps.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. Apparatus for marking a workpiece comprising, a marking wheel housing, a wheel rotatably mounted on said housing and having a plurality of marking elements on the periphery thereof, a support arm having a first end portion pivotally connected to said housing, said support arm having a second end portion opposite said first end portion, a frame, said support arm second end portion being pivotally connected to said frame, support means for guiding said frame along a transverse linear path relative to the workpiece, control means for moving said frame incrementally along said transverse linear path to selectively position said housing and said marking wheel for marking the workpiece with a series of marks, lift means extending between said frame and said support arm for pivoting said housing through an arcuate path between a raised position and a lowered position for marking, stamping means carried by said lift means and extending from and aligned with said lift means for reciprocating said housing to impress the desired element on the workpiece when said marking wheel is in said lowered position, and said stamping means being movable by operation of said lift means in a direction aligned with the direction of movement of said stamping means to sequentially impress said series of marks on the workpiece as said marking wheel is incrementally moved in said linear path transverse to the combined direction of movement of said lift means and said stamping means.

2. Apparatus as set forth in claim 1 which includes, an indexing ratchet actuated by said control means to incrementally advance said frame together with said marking wheel housing laterally of the workpiece in steps of a preselected length in timed sequence with reciprocation of said marking wheel housing upon actuation of said stamping means, and means for supporting said indexing ratchet adjacent to said frame to move said frame along said linear path which is transverse to a path of pivotal movement of said support arm.

3. Apparatus as set forth in claim 1 which includes, return means connected at one end to said support means and at an opposite end to said frame for rapidly advancing said frame along said linear path transverse to the path of reciprocation of said marking wheel housing in a continuous motion to return said marking wheel housing to an initial marking position upon completion of marking the workpiece with a preselected series of elements.

4. Apparatus as set forth in claim 3 in which said return means includes, a piston cylinder assembly having an extensible piston, said assembly being connected to said support means with said piston being connected to said frame, and said assembly being operable upon actuation to extend said piston and advance said frame in a continuous motion in a return path along said transverse linear path of the incremental movement of said frame back to the point of origination of the incremental movement.

5. Apparatus as set forth in claim 1 which includes, an indexing motor for incrementally rotating said wheel on said marking wheel housing to place a selected one of said marking elements in position opposite the workpiece for marking after reciprocation of said marking wheel housing to mark the workpiece, said indexing motor mounted on said frame above said support arm, drive shaft means extending from said indexing motor to said wheel for drivingly connecting said indexing motor to said wheel, and means connected to and movable with said support arm for rotatably supporting said drive shaft means.

6. Apparatus as set forth in claim 1 which includes, means for locking said frame in a preselected position along said transverse linear path opposite the workpiece to locate said wheel in a desired position for impressing a mark on the workpiece by reciprocation of said marking wheel housing.

7. Apparatus as set forth in claim 1 which includes, roller means mounted on said frame for supporting said frame on said support means for movement of said frame transversely of the pivotal movement of said support arm, said support means including a guide track rigidly supported in a position parallel to said transverse linear path, said roller means being positioned on said guide track for movement thereon, and indexing means engageable with said frame and connected to said support means for actuating movement of said roller means on said guide track to move said frame and said marking wheel housing to a preselected position along said transverse linear path.

8. Apparatus as set forth in claim 1 in which, said lift means includes a piston cylinder assembly having a piston extensible and retractable in a preselected line of action, said lift piston cylinder assembly being connected to said frame, said stamping means including a piston cylinder assembly having a piston extensible and retractable along a line of action axially aligned with said preselected line of action of said lift means, said stamping cylinder being connected to said lift piston and movement of said lift piston into and out of said lowered position moves said stamping cylinder into and out of position for impressing the desired element on the workpiece, said stamping piston being connected to said support arm, and said lift piston and said stamping piston having aligned lines of action whereby extension and retraction of said lift piston moves said stamping piston into and out of position opposite the workpiece for marking the workpiece.

9. Apparatus as set forth in claim 1 in which, said support arm includes a pair of arm members pivotally connected at one end to said frame and at an opposite end to said marking wheel housing, said pair of arm members being pivotally connected to said stamping means, and said pair of arm members being movable in a first direction with said frame along said transverse linear path and in a second direction along an arcuate path transverse to the movement of said frame to position said marking wheel housing in position for impressing a series of marks on the workpiece.

10. Apparatus as set forth in claim 1 which includes, a slide assembly associated with said control means for supporting said frame for traversing movement along said linear path relative to the workpiece, return means extending between said support means and said frame for advancing said frame in a continuous motion along said linear path, and said return means being positioned in underlying spaced parallel relation with said slide assembly.

* * * * *